United States Patent [19]

Cuisia

[11] 4,399,098

[45] Aug. 16, 1983

[54] PREVENTION OF CORROSION IN AQUEOUS SOLUTIONS

[75] Inventor: Dionisio G. Cuisia, Chicago, Ill.

[73] Assignee: Dearborn Chemical Company, Lake Zurich, Ill.

[21] Appl. No.: 303,964

[22] Filed: Sep. 21, 1981

[51] Int. Cl.[3] ..... C23F 11/06

[52] U.S. Cl. ..... 422/13; 210/750; 252/392; 422/16

[58] Field of Search ..... 210/749, 750, 757; 252/188.28, 392, 403; 422/16, 13

[56] References Cited

U.S. PATENT DOCUMENTS

| | | | |
|---|---|---|---|
| 2,658,062 | 11/1953 | Jones | 252/46.7 |
| 3,962,113 | 6/1976 | Schiess | 252/188.28 |
| 4,079,018 | 3/1978 | Noack | 252/392 |
| 4,238,349 | 12/1980 | Larsen et al. | 252/392 |
| 4,269,717 | 5/1981 | Slovinsky | 210/750 |

OTHER PUBLICATIONS

Chemical Abstracts, vol. 74, 116296h, 1971, "Surface Activity of Some Amino Compounds."

Issa et al., *U.A.R. J. Chem.,* 13, No. 1, pp. 121–126 (1970).

*Primary Examiner*—Peter A. Hruskoci

*Attorney, Agent, or Firm*—Mark T. Collins

[57] ABSTRACT

A method for treating water to retard corrosion due to dissolved oxygen, especially boiler feed waters and boiler water condensates, is disclosed. Semicarbazide and its salts are highly effective oxygen scavengers for use in aqueous systems and thereby effect reduction of corrosion resulting from dissolved oxygen.

10 Claims, No Drawings

PREVENTION OF CORROSION IN AQUEOUS SOLUTIONS

This invention is directed to a process for treating water systems to prevent metal corrosion which is specifically due to dissolved oxygen. The process is particularly useful in preventing such corrosion where the water is exposed to ferrous surfaces. The crux of the invention is the maintenance of about 0.001 to 500 ppm of semicarbazide or its salts in the aqueous system. The invention is particularly useful in treatment of boiler water, including feed waters and condensates. The semicarbazide and its salts remove the dissolved oxygen in such aqueous solutions, thereby preventing corrosion which would otherwise be caused by the dissolved oxygen.

So far as I am aware, semicarbazide has never before been used as an oxygen scavenger in aqueous systems. U.S. Pat. No. 2,658,062 discloses its use with phosphorus sulfide in hydrocarbons as a detergent and antioxidant, but in a field unrelated to aqueous systems.

In steam generating plants, it is generally necessary to remove dissolved oxygen from the feed water. There are various systems available for accomplishing this in the prior art. For example, oxygen can be partially removed by exposing the water to either a vacuum or thermal deaeration or both. However, these two treatments do not completely remove the oxygen and it is, therefore, customary to attempt to remove the balance of the oxygen by means of chemical scavenging agents, such as sodium sulfite and hydrazine. These two chemicals are widely used in treatment of water for boilers, hot water plants, and the like.

It has now been found that semicarbazide, as the base, or in salt form, is capable of removing dissolved oxygen in the water, thereby minimizing corrosion problems. In fact, my research has shown that semicarbazide performs even better than sodium sulfite and hydrazine in reducing dissolved oxygen in water.

The effectiveness of semicarbazide as an oxygen scavenger was investigated under experimental boiler conditions, i.e., 375 psig and 442° F.

During the test, the boiler feedwater is saturated with dissolved oxygen by continuous aeration. The dissolved oxygen in the feedwater ranged from 9 to 10 mg/l (as $O_2$). The boiler steam is condensed through a heat exchanger producing a condensate temperature of 55° F. The condensate is then passed through a chamber in which an oxygen probe is inserted to monitor the dissolved oxygen. A blank run without an oxygen scavenger is first conducted until a constant oxygen reading is attained. Once the initial dissolved oxygen reading has been established, the oxygen scavenger being evaluated is fed into the boiler. The reduction of the dissolved oxygen in the condensate is then recorded.

Other boiler water treatment chemicals such as sodium hydroxide (caustic soda) and disodium phosphate for alkalinity and calcium hardness controls are also added during the experimental runs. The feedwater contains 10 ppm (as $CaCO_3$) total hardness.

At a dosage of 60 ppm active in the feedwater of oxygen scavengers, the following results were obtained.

| Ex. No. | Oxygen Scavengers | Dissolved Oxygen (mg/l) in the Condensate Initial | Final | % Reduction of Dissolved Oxygen |
|---|---|---|---|---|
| 1 | Sodium sulfite ($Na_2SO_3$) | 3.00 | 0.095 | 96.8 |
| 2 | Hydrazine ($N_2H_4$) | 3.75 | 0.10 | 97.3 |
| 3 | Semicarbazide hydrochloride ($NH_2CONHNH_2HCl$) | 3.60 | 0.07 | 98.0 |

In addition to the hydrochloride, other suitable semicarbazide salts include, for example, the sulfate, nitrate, phosphate, borate, hydrobromide, citrate, oxalate, and the like.

In the specification and claims, by boiler feed water, boiler water, and boiler water system is meant the water in the boiler system plus attendant minor amounts of salts and dissolved air and/or oxygen that result from the use of commercially available waters in boiler systems. Such boiler systems may also include small amounts of additives normally used for control of corrosion, scaling, sedimentation, pH, hardness and the like.

Suitably, semicarbazide is used as the sole oxygen scavenger. However, other oxygen scavengers may be used along with it, singly or in combination, e.g., sodium sulfite, hydrazine, hydroquinone, and the like.

As a broad operable range, 0.001 to 500 ppm of semicarbazide or its salt is added to the water in the aqueous system being treated. More preferably, 0.01 to 100 ppm is added, and even more preferably, 5 to 50 ppm.

I claim:

1. A method for control of corrosion of ferrous metal surfaces in boiler water systems caused by dissolved oxygen in the water which comprises adding to the system from 0.001 to 500 ppm of an oxygen scavenger comprising semicarbazide or a salt thereof.

2. The method according to claim 1 in which semicarbazide is added to the boiler water system at a level of 0.01 to 100 ppm.

3. The method according to claim 1 in which the semicarbazide is in the form of semicarbazide hydrochloride.

4. The method according to claim 1 in which the boiler water system comprises feed waters for a boiler.

5. The method according to claim 1 in which the semicarbazide is added to the boiler water system at a dosage level of 5 to 50 ppm.

6. The method according to claim 1 in which semicarbazide hydrochloride is the sole oxygen scavenger added.

7. The method according to claim 1 in which the ferrous metal surfaces are steel and the semicarbazide is added to the boiler water system at a dosage level of 5 to 50 ppm.

8. The method according to claim 1 in which the boiler water system comprises boiler water condensates.

9. The method according to claim 1 in which one or more other oxygen scavengers are added to the system.

10. The method according to claim 1 in which the boiler water system comprises alkaline boiler water.

* * * * *